US006042449A

United States Patent [19]

Ishimoto

[11] Patent Number: 6,042,449

[45] Date of Patent: Mar. 28, 2000

[54] SELF-STANDING TRAVELING TOY

[75] Inventor: Zenichi Ishimoto, Tokyo, Japan

[73] Assignee: Nikko Co., Ltd., Tokyo, Japan

[21] Appl. No.: 09/168,438

[22] Filed: Oct. 7, 1998

[30] Foreign Application Priority Data

Oct. 7, 1997 [JP] Japan ..... 9-274677

[51] Int. Cl.[7] ..... A63H 1/20

[52] U.S. Cl. ..... 446/234; 446/233; 446/237

[58] Field of Search ..... 446/3, 233, 236, 446/237, 238, 431, 457, 458, 462, 234

[56] References Cited

U.S. PATENT DOCUMENTS

| | | | |
|---|---|---|---|
| 174,265 | 2/1876 | Long et al. | 446/238 |
| 1,513,143 | 10/1924 | Welch et al. | 446/233 |
| 2,496,603 | 2/1950 | Schwanegel | 446/237 |
| 3,387,778 | 6/1968 | Althaus | 446/431 X |
| 3,650,067 | 3/1972 | Greenwood | 446/233 |
| 4,463,518 | 8/1984 | Smathers et al. | 446/237 |
| 4,556,396 | 12/1985 | Kennedy et al. | 446/233 X |
| 4,767,376 | 8/1988 | Hanzawa | 446/396 X |
| 4,902,271 | 2/1990 | Yoneda | 446/431 |
| 5,194,032 | 3/1993 | Garfinkel | 446/178 |
| 5,820,439 | 10/1998 | Hair, III | 446/233 |
| 5,823,845 | 10/1998 | O'Berrigan | 446/234 |

*Primary Examiner*—Sam Rimell
*Attorney, Agent, or Firm*—Young & Thompson

[57] ABSTRACT

The present invention provides a toy comprising: a rotator which is capable of exhibiting a gyro effect; a driver connected to the rotator for rotating the rotator to allow the rotator to exhibit the gyro effect; and a device capable of causing the toy falling down or tilting to show a spin or a rotation in the same direction as a rotation of the rotator so that a rotational axis of the rotator rotates or swings to draw a cone-shaped locus thereof, thereby to reduce swing motion of the rotational axis or to narrow a spread of the cone-shaped locus, whereby the rotational axis of the rotator is forced and moved onto a center and vertical axis, and the toy comes stand right-up and stabilized in a standing right-up position.

12 Claims, 5 Drawing Sheets

SELF-STANDING TRAVELING TOY

BACKGROUND OF THE INVENTION

The present invention relates to a self-standing traveling toy and more particularly to a radio-controlled self-standing traveling toy.

Various types of conventional radio-controllable traveling toys have been known in the art. Most of such the conventional radio-controllable traveling toys show stable traveling performance through four or more wheels or caterpillars.

In the above circumstances, it has been required to provide a more attractive traveling toy than the conventional radio-controllable traveling toys showing normal traveling performances, wherein the attractive traveling toy is required to show a unique traveling performance and a unique feature which are quite different from stable and normal traveling performances.

SUMMARY OF THE INVENTION

Accordingly, it is an object of the present invention to provide a novel self-standing traveling toy free from the above problems.

It is a further object of the present invention to provide a novel self-standing traveling toy which shows very unique and attractive performance and feature which are quite different from those of the conventional traveling toys.

The present invention provides a toy comprising: a rotator which is capable of exhibiting a gyro effect; a driver connected to the rotator for rotating the rotator to allow the rotator to exhibit the gyro effect; and a device capable of causing the toy falling down or tilting to show a spin or a rotation in the same direction as a rotation of the rotator so that a rotational axis of the rotator rotates or swings to draw a cone-shaped locus thereof, thereby to reduce swing motion of the rotational axis or to narrow a spread of the cone-shaped locus, whereby the rotational axis of the rotator is forced and moved onto a center and vertical axis, and the toy stands up and is stabilized in a standing position.

In accordance with the present invention, a novel self-standing traveling toy has both self-standing and traveling functions. The self-standing function of the novel self-standing traveling toy prevents the toy from falling down or causes the toy having already fallen down to stand up. The self-standing function also prevents the toy from tilting or to causes the toy having already tilted to stand upright. The traveling function of the novel self-standing traveling toy includes forward and backward motion as well as right or left turning motion. The self-standing traveling toy is radio-controllable.

The above and other objects, features and advantages of the present invention will be apparent from the following descriptions.

BRIEF DESCRIPTION OF THE DRAWINGS

A preferred embodiment according to the present invention will be described in detail with reference to the accompanying drawings.

DESCRIPTION OF THE PREFERRED EMBODIMENT

Figure 1:
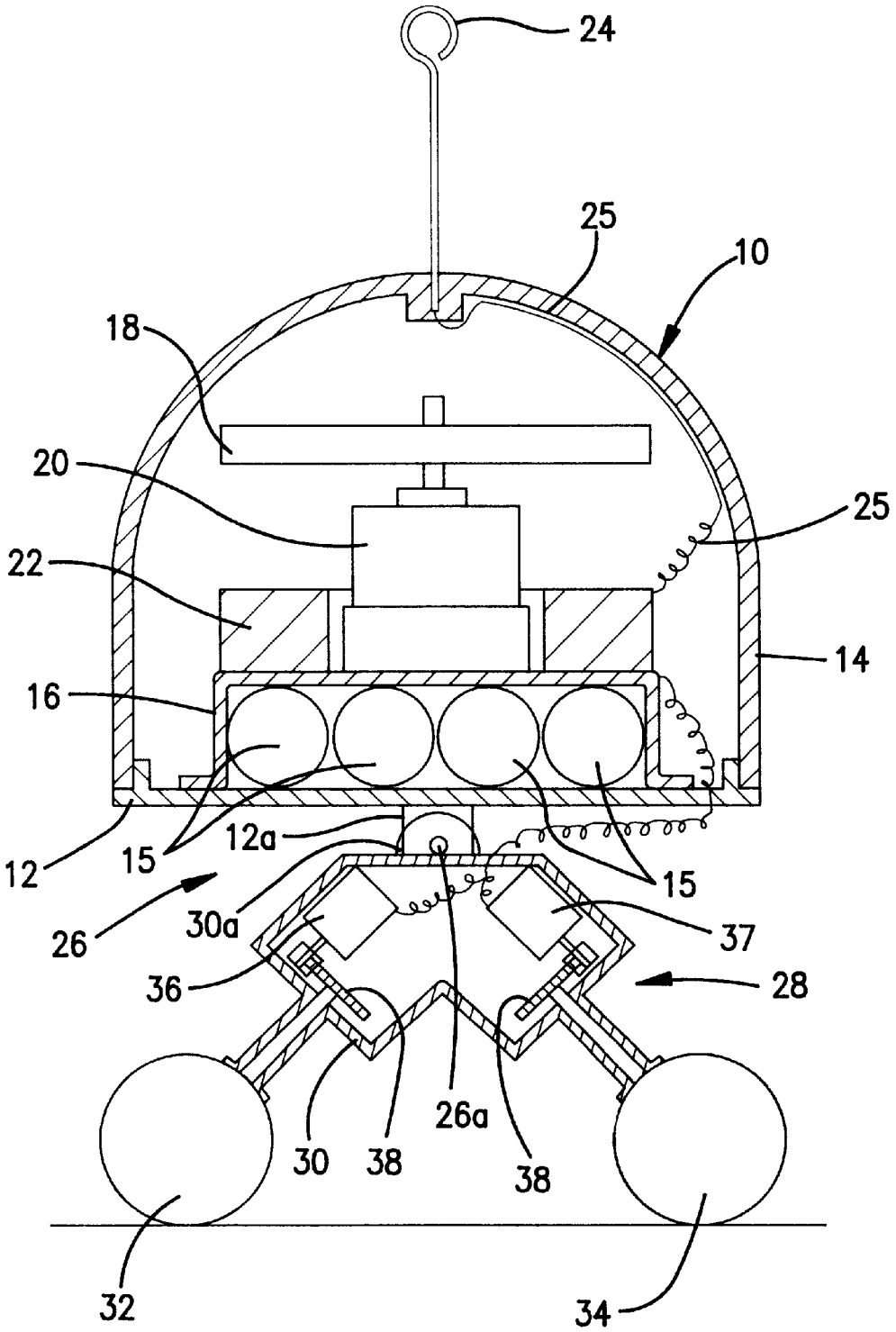
FIG. 1 is a cross sectional elevation view illustrative of a novel toy in a preferred embodiment in accordance with the present invention.

The present invention provides a toy comprising: a rotator which is capable of exhibiting a gyro effect; a driver connected to the rotator for rotating the rotator to allow the rotator to exhibit the gyro effect; and a device capable of causing the toy falling down or tilting to show a spin or a rotation in the same direction as a rotation of the rotator so that a rotational axis of the rotator rotates or swings to draw a cone-shaped locus thereof, thereby to reduce swing motion of the rotational axis or to narrow a spread of the cone-shaped locus, whereby the rotational axis of the rotator is forced and moved onto a center and vertical axis, and the toy stands up and is stabilized in a standing position.

It is preferable that the rotator has a weight distribution which is biased toward a peripheral region of the rotator and which is symmetrical with reference to the rotational axis.

It is further preferable that the rotator comprises a fly-wheel.

It is also preferable that the peripheral region of the rotator is made of a heavier material than a material of a center portion of the rotator so that the peripheral region of the rotator is heavier than the center region of the rotator.

It is also preferable that the peripheral region of the rotator is thicker than a center region of the rotator so that the peripheral region of the rotator is heavier than the center region of the rotator.

It is also preferable that the driver comprises: a motor; a rotary shaft extending from the motor and being mechanically fixed to the rotator; and a control circuit electrically connected to the motor for controlling a rotational operation of the motor.

It is also preferable that the device comprises: a pair of traveling wheels capable of rotations, which are in contact with a ground; a traveling wheel driver mechanically connected to the traveling wheels for rotating the traveling wheels; and a traveling wheel controller electrically connected to the traveling wheel driver for controlling at least rotational directions of the traveling wheels independently from each other, so that if the toy falls down or tilts, then the traveling wheels rotate in the same direction as the rotation of the rotator to allow the toy to show the spin or the rotation in the same direction as the rotation of the rotator, whereby the toy stands up and is stabilized in a standing position.

It is also preferable that the device comprises: a body accommodating at least the rotator; a traveling section having at least the traveling wheels and the traveling wheel driver; and a hinged mechanical connector providing a mechanical connection between the body and the traveling section, so as to permit the body to swing in relation to the traveling section thereby promoting the toy to stand-up.

It is also preferable that the toy is radio-controllable.

In accordance with the present invention, a novel self-standable traveling toy has both functions of self-standing and traveling. The self-standing function of the novel self-standable traveling toy includes a function to prevent the toy from falling down or to cause the toy having already fallen down to stand up. The self-standing function also includes a function to prevent the toy from tilting or to cause the toy having already tilted to stand upright. The traveling function of the novel self-standable traveling toy includes forward and backward travelings as well as right or left turning. The self-standable traveling toy is radio-controllable.

First Embodiment

Figure 2:
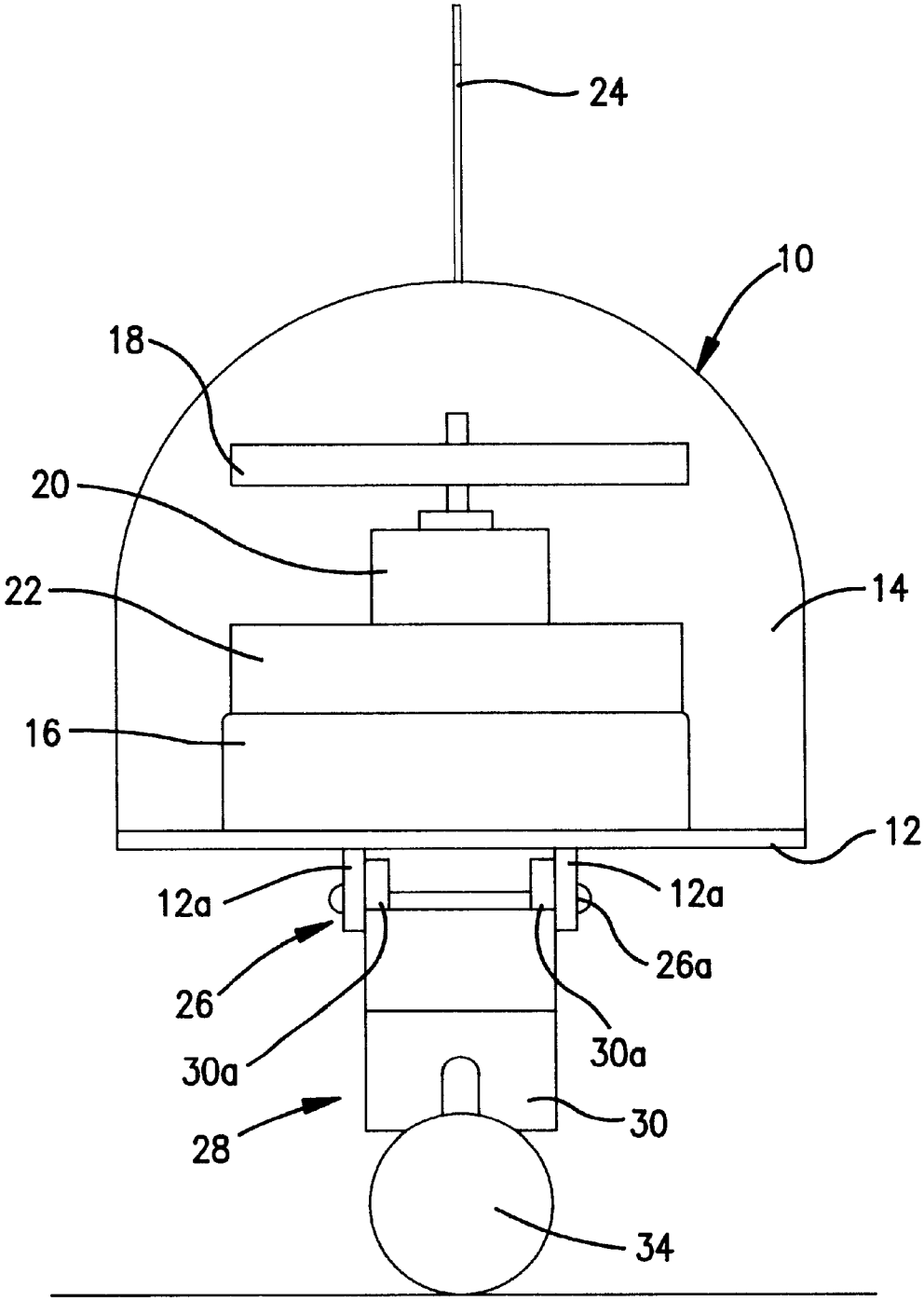
FIG. 2 is a right side view illustrative of a novel toy in a preferred embodiment in accordance with the present invention.

A first embodiment according to the present invention will be described in detail with reference to FIGS. 1 and 2. A novel self-standing traveling toy comprises a traveling section 28 for having the self-standing traveling toy travel and a body 10 supported by the traveling section 28. The body 10 is made of a synthetic resin. The body 10 is dome-shaped. The body 10 further comprises a disk-shaped base plate 12 and a hemispherical-shaped case 14 over the disk-shaped base plate 12. The hemispherical-shaped case 14 is made of a transparent synthetic resin so that an internal structure of the hemispherical-shaped case 14 is visible. A battery case 16 is provided on the disk-shaped base plate 12 for accommodating four batteries 15. A motor 20 is also provided at a center position and on the battery case 16. The motor 20 has a rotary shaft which extends in the upright direction which is vertical to the disk-shaped base plate 12. A fly-wheel 18 is fixed to a projecting portion of the rotary shaft of the motor 20, so that the fly-wheel 18 rotates upon rotation of the rotary shaft of the motor 20. The fly-wheel 18 shows a rotation at a high speed and in an anti-clockwise direction in the plan view. The rotation of the fly-wheel 18 is oriented on a plane parallel to the disk-shaped base plate 12 and on a rotational axis corresponding to the rotary shaft of the motor 20. The fly-wheel 18 may be made of a metal.

In place of the fly-wheel 18, any rotators are available, each of which, however, has substantially the same functions as the fly-wheel 18. The available rotator is designed to exhibit a large rotating inertial force and also the available rotator has such a weight distribution which is biased toward a peripheral region of the rotator and which is symmetrical with reference to the rotational axis. For example, the rotator has a weight distribution which increases toward the peripheral region of the rotator. The peripheral portion of the rotator may be heavier than the center portion of the rotator, wherein the peripheral portion is made of a heavier material than a material of the center portion or is thicker than the center portion.

A driver control circuit 22 for controlling the motor 20 is further provided around the motor 20 and on the battery case 16 so as to keep symmetrical weight distribution of the body. The above battery case 16, the motor 20, the fly-wheel 18 and the driver control circuit 22 are accommodated in the hemispherical-shaped and transparent case 14 of the body 10. An antenna 24 extends uprightly from a top of the hemispherical-shaped and transparent case 14 of the body 10. A lead wire 25 is further provided which connects the antenna 24 to the driver control circuit 22 for transmitting a control signal from the antenna 24 to the driver control circuit 22.

The body 10 is mechanically connected through a hinged supporting member 26 to the traveling section 28 so that the body 10 is positioned over the traveling section 28 and is mechanically supported by the hinged supporting member 26 on the traveling section 28. The hinged supporting member 26 allows the body 10 to swing in relation to the traveling section 28. The hinged supporting member 26 comprises a pair of upper parts 12*a* and 12*a* and a pair of lower parts 30*a* and 30*a*, wherein the upper parts 12*a* and 12*a* and the lower parts 30*a* and 30*a* are mechanically connected through a pin 26*a* to form a hinged connection structure. The upper parts 12*a* and 12*a* are fixed to the center of the bottom surface of the disk-shaped base plate 12. The lower parts 30 and 30*a* are fixed to the center of a top flat surface of the traveling section 28. The hinged supporting member 26 is positioned on an extension line of the rotational axis of the rotary shaft of the motor 20.

The traveling section 28 comprises a case 30 with a pair of leg portions extending downwardly and obliquely to form an inverse V-shape, and a pair of spherical traveling wheels 32 and 34 connected to ends of the leg portions extending from the case 30. The leg portions of the traveling section 28 extend to form an oblique angle of 45 degrees with reference to a ground or a plane parallel to the top flat surface of the case 30, so that the leg portions of the traveling section 28 has an included angle of 90 degrees. The paired spherical traveling wheels 32 and 34 have ground contact points which are distanced from each other and are positioned on a single straight line. The spherical traveling wheels 32 and 34 may be made of a rubber. The spherical traveling wheels 32 and 34 rotate around longitudinal axes of the paired leg portions of the traveling section 28, wherein the rotational axes of the spherical traveling wheels 32 and 34 have oblique angles of 45 degrees with reference to the ground. The rotations of the spherical traveling wheels 32 and 34 make the toy to travel. The case 30 of the traveling section 28 also accommodates a pair of traveling motors 36 and 37 and a pair of reduction gear mechanisms 38 connected to the traveling motors 36 and 37. The reduction gear mechanisms 38 are also connected through rotary shafts to the spherical traveling wheels 32 and 34, so that the traveling motors 36 and 37 are mechanically connected through the reduction gear mechanisms 38 and the rotary shafts to the spherical traveling wheels 32 and 34. The traveling motors 36 and 37 are also connected though lead wires to the driving control circuit 22 which are also, as described above, connected through the lead wires 25 to the antenna 24, whereby the controls signals are transmitted from the antenna 24 through the lead wire 25 and the driving control circuit 22 to the traveling motors 36 and 37, so that the traveling motors 36 and 37 are operated under the controls of the control signals. The traveling motors 36 and 37 are capable of rotations in both directions, for example, forward and reverse directions. The rotations of the traveling motors 36 and 37 are separately controlled by the control signals. This means that the rotations of the paired traveling wheels 32 and 34 are separately controlled by the control signals. This separate controls to the rotations of the paired spherical traveling wheels 32 and 34 make it possible that the toy travels in forward and backward directions and also shows right and left turns and a spin.

Figure 3:
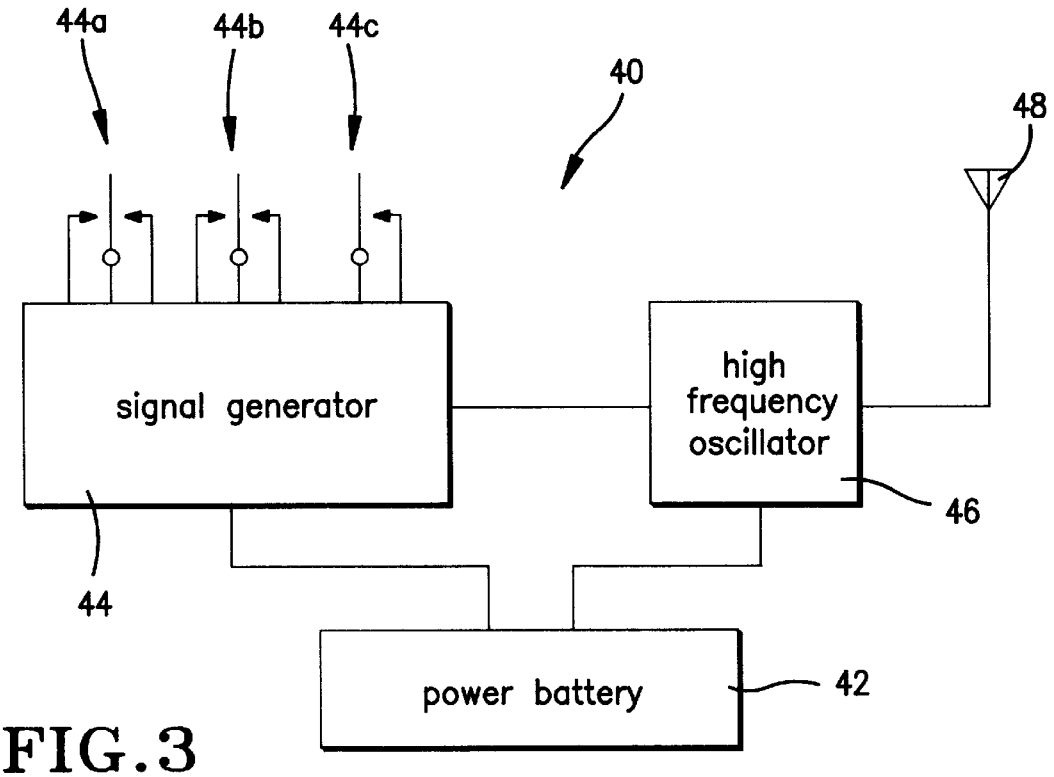
FIG. 3 is a block diagram illustrative of a control circuit in a transmitter for transmitting radio control signals to the toy in a preferred embodiment in accordance with the present invention.

FIG. 3 is a block diagram illustrative of a control circuit in a transmitter to be used for transmitting radio control signals to the antenna 24 of the above novel self-standable traveling toy. The transmitter has a control circuit 40 which comprises a power battery 42, a signal generator 44, a high frequency oscillator 46 and a transmission antenna 48. The signal generator 44 and the high frequency oscillator 46 are electrically connected to the power battery 42 for receiving powers for operations of the signal generator 44 and the high frequency oscillator 46. The signal generator 44 has a first switch 44*a* for switching between forward and reverse motion, a second switch 44*b* for switching between right and left turns and a third switch 44*c* for switching spin-turn or not in order to cause the toy having already fallen down to stand up, or in order to cause the toy having already tilted to stand upright. The control signals arc generated in accordance with the switching operations of the first, second and third switches 44*a*, 44*b* and 44*c* for subsequent transmission through the high frequency oscillator 46 and the transmission antenna 48 to the receiving antenna 24 of the toy. The control signals received by the receiving antenna 24 of the toy are then transmitted through the lead wire 25 to the driver control circuit 22.

Figure 4:
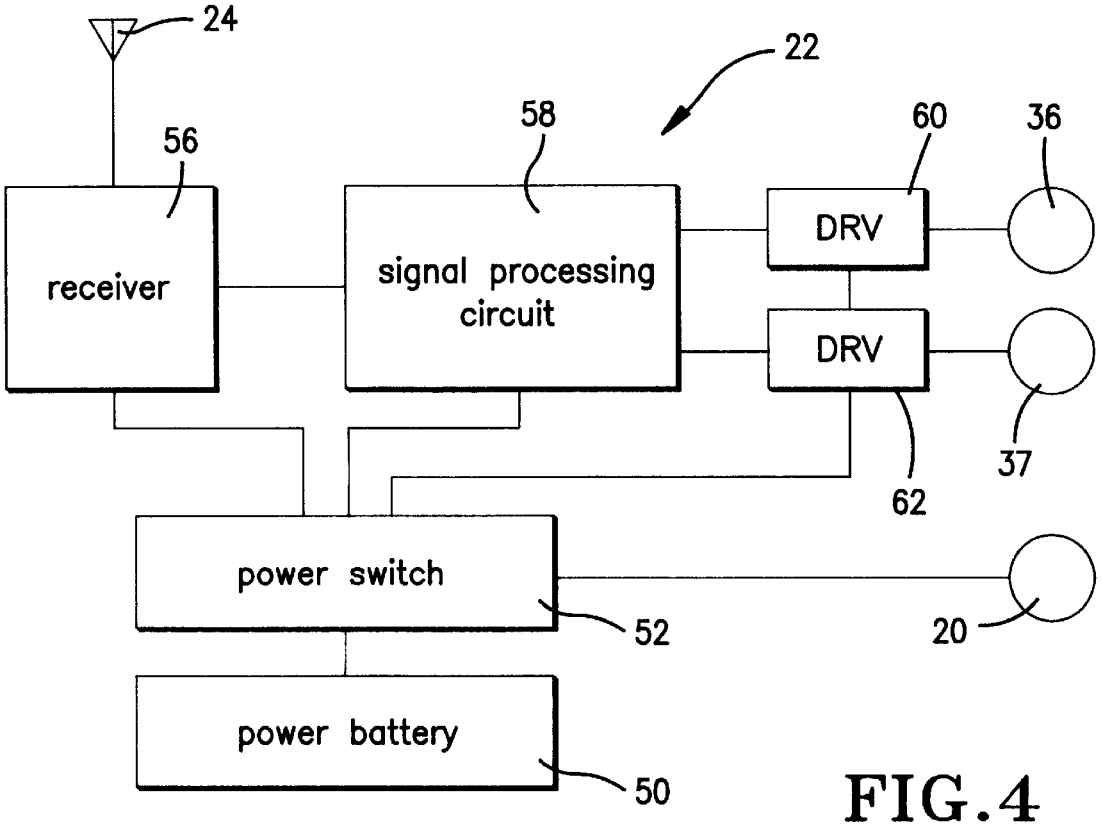
FIG. 4 is a block diagram illustrative of a driver control circuit for controlling a driver for rotating a fly-wheel accommodated in a body of the toy in a preferred embodiment in accordance with the present invention.

FIG. 4 is a block diagram illustrative of the driver control circuit 22 for controlling the motor for rotating the fly-wheel 18. The driver control circuit 22 comprises a power battery 50, a power switch 52, a receiver 56, a control signal processing circuit 58, and first and second motor drive circuits 60 and 62. The power battery 50 is connected through the power switch 52 to the motor 20 for driving or rotating the fly-wheel 18. The power battery 50 is also connected through the power switch 52 to the receiver 56 for operation of the receiver 56. The power battery 50 is also connected through the power switch 52 to the control signal processing circuit 58 for operations of the control signal processing circuit 58. The power battery 50 is also connected through the power switch 52 to the first and second motor drive circuits 60 and 62 for operations of the first and second motor drive circuits 60 and 62. The control signals having been transmitted from the transmission antenna 48 are received by the receiving antenna 24 of the toy. The control signals are then transmitted through the receiver 56 and the control signal processing circuit 58 to the first and second motor drive circuits 60 and 62 for controls to operations of the first and second motor drive circuits 60 and 62 whereby the traveling motors 36 and 37 are separately controlled by the control signals. The control signal from the control signal processing circuit 58 is to decide high or low speed rotation of each of the first and second motor drive circuits 60 and 62 and also to decide rotation directions, for example, clockwise and anti-clockwise directions.

Figure 5A:
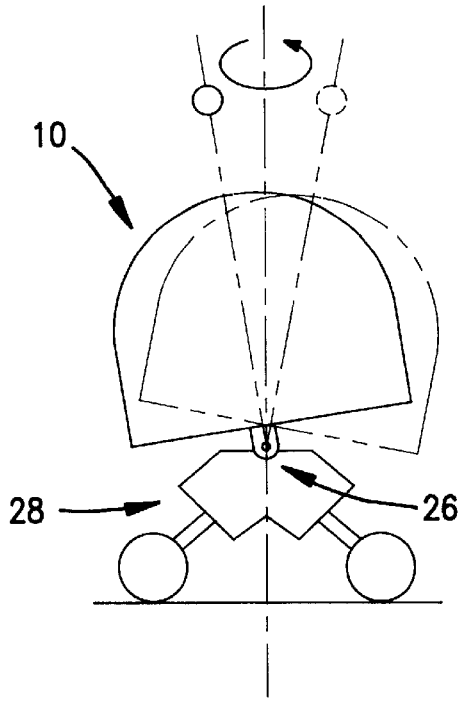
FIG. 5A is a front view illustrative of toy which is swinging in a preferred embodiment in accordance with the present invention.
Figure 5B:
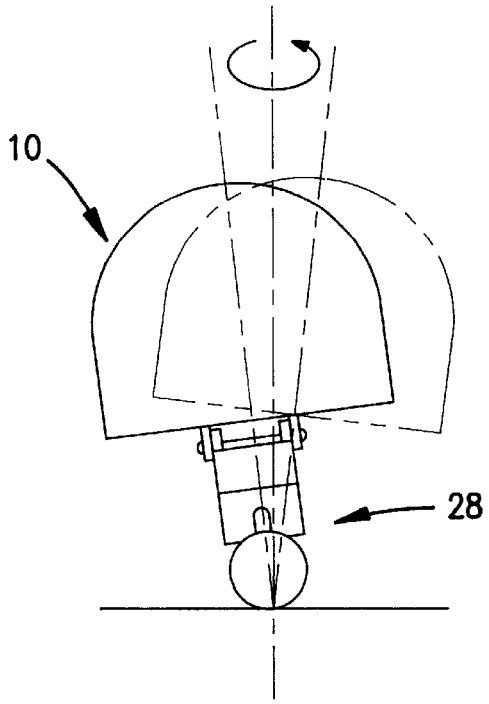
FIG. 5B is a right side view illustrative of the toy which is swinging in a preferred embodiment in accordance with the present invention.
Figure 6A:
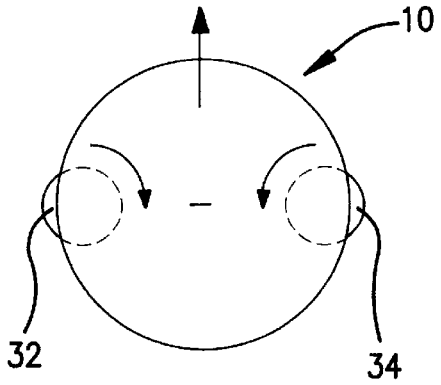
FIG. 6A is a plan view illustrative of rotation directions of paired traveling wheels of a novel self-standing traveling toy in forward traveling.
Figure 6C:
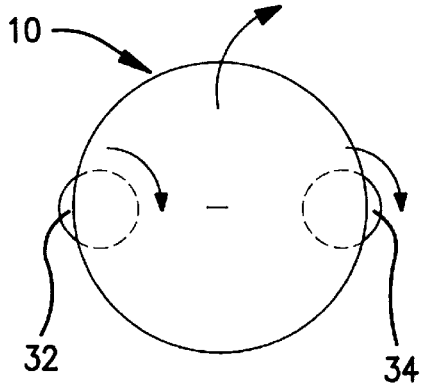
FIG. 6C is a plan view illustrative of rotation directions of paired traveling wheels of a novel self-standing traveling toy in right-turning.
Figure 6B:
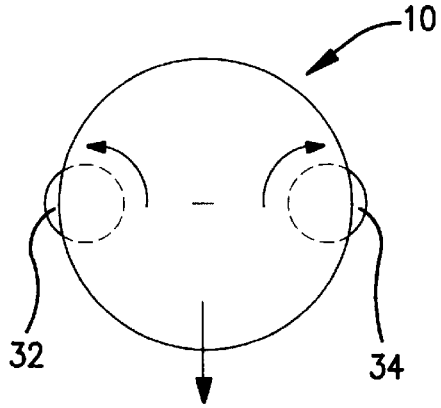
FIG. 6B is a plan view illustrative of rotation directions of paired traveling wheels of a novel self-standing traveling toy in backward traveling.
Figure 6D:
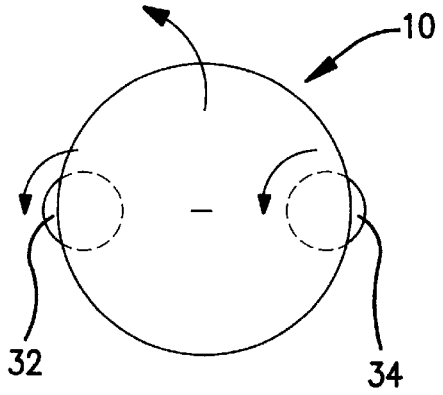
FIG. 6D is a plan view illustrative of rotation directions of paired traveling wheels of a novel self-standing traveling toy in left-turning.
Figure 6E:
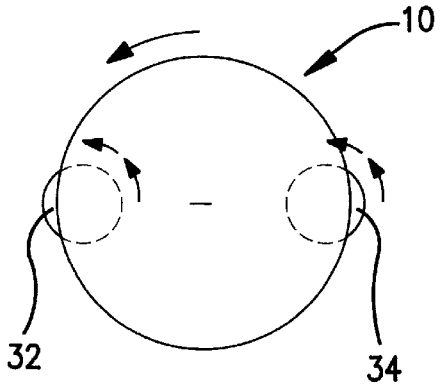
FIG. 6E is a plan view illustrative of rotation directions of paired traveling wheels of a novel self-standing traveling toy in spin-turning.

Refer now to FIGS. 5A–5B and FIGS. 6A–6E. When the power switch 52 of the driver control circuit 22 is opened, then the motor 20 for the fly-wheel 18 is started to rotate whilst the receiver 56 and the control signal processing circuit 58 are supplied with a power from the power battery 50 through the power switch 52. The fly-wheel 18 continues to rotate during activation of the toy to stabilize the toy with the gyro effect due to the high speed rotation of the fly-wheel 18 until the power switch 52 turns OFF. Namely, the rotation of the motor 20 causes rotation of the fly-wheel 18 in the anti-clockwise direction at a high rotation speed, for example, about 10000 rpm, whereby the toy stands up on the paired spherical traveling wheels 32 and 34. The gyro effect due to the high speed rotation of the fly-wheel 18 stabilizes the standing position of the toy. As illustrated in FIGS. 5A and 5B, even if the toy shows swing in the two-dimensional directions due to any external force, then this swing motion is reduced, and the toy comes stand right-up and stabilized in the standing right-up by the gyro effect of the high speed rotation of the fly-wheel in combination with the rotations of the spherical traveling wheels 32 and 34 in the same direction as the fly-wheel 18.

When the transmitter is operated so that the first switch 44*a* is switched to the forward traveling side, the spherical traveling wheel 32 rotates in the clockwise direction, whilst the spherical traveling wheel 34 rotates in the anti-clockwise direction, whereby the toy travels in the forward direction.

When the transmitter is operated so that the first switch 44*a* is switched to the backward traveling side, the spherical traveling wheel 32 rotates in the anti-clockwise direction, whilst the spherical traveling wheel 34 rotates in the clockwise direction, whereby the toy travels in the backward direction.

When the transmitter is operated so that the second switch 44*b* is switched to the right-turning side, the spherical traveling wheels 32 and 34 rotate in the clockwise direction, whereby the toy turns right.

When the transmitter is operated so that the second switch 44*b* is switched to the left-turning side, the spherical traveling wheels 32 and 34 rotate in the anti-clockwise direction, whereby the toy turns left.

If the toy loses balance and is tilted by an external force, then the third switch 44*c* turns ON, whereby the spherical traveling wheels 32 and 34 rotate in the same direction as the fly-wheel 18, for example, in the anti-clockwise direction, whereby the rotational axis of the fly-wheel rotates or swings to draw a cone-shaped locus thereof. Since the fly-wheel shows the gyro effect to reduce the swing motion or narrow the spread of the locus cone, the rotational axis of the fly-wheel is forced toward the center and vertical axis thereof, whereby the toy stands up on the two spherical traveling wheels 32 and 34. The hinged supporting member 26 between the body 10 and the traveling section 28 allows the toy to stand up.

If the toy falls down, then the third switch 44*c* turns ON, whereby the spherical traveling wheels 32 and 34 rotate in the same direction as the fly-wheel 18, for example, in the anti-clockwise direction the toy shows the spin in the same direction as the rotation of the fly-wheel by the rotations of the spherical traveling wheels in the same direction as the fly-wheel upon operation of the third switch 44*c*, whereby the rotational axis of the fly-wheel rotates or swings to draw a cone-shaped locus thereof. Since the fly-wheel shows the gyro effect to reduce the swing or narrow the spread of the locus cone, the rotational axis of the fly-wheel is forced toward the center and vertical axis thereof, whereby the toy stands upon the two spherical traveling wheels 32 and 34.

In detail, if the toy falls down or is tilted, then the toy shows the spin in the same direction as the rotation of the fly-wheel by the rotations of the spherical traveling wheels in the same direction as the fly-wheel upon operation of the third switch 44*c*, whereby the rotational axis of the fly-wheel rotates or swings to draw a cone-shaped locus thereof. Since the fly-wheel shows the gyro effect to reduce the swing or narrow the spread of the locus cone, the rotational axis of the fly-wheel is forced toward the center and vertical axis thereof, whereby the toy comes stand right-up with the two spherical traveling wheels 32 and 34.

As a modification, it is possible that, in place of the two spherical traveling wheels, there is provided any device which causes a spin of the toy falling down or tilting so that the rotational axis of the fly-wheel rotates or swings to draw a cone-shaped locus thereof, so that the fly-wheel shows the gyro effect to reduce the swing or narrow the spread of the locus cone, the rotational axis of the fly-wheel is forced toward the center and vertical axis thereof, whereby the toy comes stand right-up and stabilized in the standing right-up position. In this case, it is further possible to change the number of the traveling wheels.

As a further modification, it is also possible to change the shape of the traveling wheels into, for example, hemispherical.

As a furthermore modification, the above toy is remote-controlled.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A toy comprising:

a gyro wheel that rotates in a plane perpendicular to an axis of the toy that is vertical when the toy is erect;

two supports for said gyro wheel that are spaced from each other in opposite radial directions from the axis, each of said supports having a rotatable end; and at least one motor operably connected to said rotatable ends for selectively (a) linearly moving the toy and (b) rotating the toy on the axis.

2. The toy of claim 1, wherein each said rotatable end comprises at least a rotatable hemispherical end portion that is connected to said at least one motor.

3. The toy of claim 1, further comprising a plate in a plane perpendicular to the axis and a gyro wheel driver thereon, said gyro wheel being connected to said gyro wheel driver, said two supports depending from said plate.

4. The toy of claim 3, further comprising a pivot connecting said plate to said two supports, said two supports depending from said pivot at right angles to each other.

5. The toy of claim 1, comprising two of said at least one motor, each said motor being connected to a different one of said two supports.

6. The toy of claim 1, wherein said two supports comprise two legs that extend at right angles to each other.

7. The toy of claim 1, further comprising, a round base in a plane perpendicular to the axis, a gyro wheel driver on said round base, said gyro wheel being connected to said gyro wheel driver, a pivot connecting said round base to said two supports which depend from said pivot at right angles to each other, two of said at least one motor, and each said rotatable end comprising at least a rotatable hemispherical end portion that is connected to a different one of said two motors.

8. The toy of claim 1, further comprising a controller that directs said at least one motor (a) to rotate said rotatable ends in a direction of rotation of said gyro wheel, causing the toy to rotate in the direction of rotation of said gyro wheel, when the axis of said gyro wheel is not vertical, and (b) to rotate said rotatable ends in opposite directions when the toy is moving linearly.

9. A toy comprising:

a gyro wheel that rotates in a first plane;

a gyro wheel driver connected to said gyro wheel for rotating said gyro wheel;

two supports for said gyro wheel driver that, when the toy is erect, are spaced from each other in opposite radial directions from an axis of rotation of said gyro wheel that is perpendicular to the first plane, each of said supports having a rotatable end on which the toy stands;

each of said two supports having a motor for selectively rotating the respective said rotatable end; and a controller that directs each said motor (a) to rotate the respective said rotatable end in a direction of rotation of said gyro wheel, causing the toy to rotate in the direction of rotation of said gyro wheel, when the axis of rotation of said gyro wheel is not vertical, and (b) to rotate each said rotatable end in an opposite direction relative to the other said rotatable end when the toy is moving linearly.

10. The toy of claim 9, wherein each said rotatable end comprises at least a rotatable hemispherical end portion that is connected to the respective said motor.

11. The toy of claim 9, further comprising a round base in a plane parallel to the first plane on which said gyro wheel driver is carried, and a pivot connecting said round base to said two supports which depend from said pivot at right angles to each other.

12. A toy that rotates and moves linearly comprising, a rotatable gyro wheel and a support therefor that consists of two legs, each of which has at least a hemispherical end that rotates independently of said hemispherical end on the other of said legs and a motor for rotating the respective said hemispherical end, and a controller that directs each said motor (a) to rotate the respective said hemispherical end in a direction of rotation of said gyro wheel when the toy rotates, and (b) to rotate each said hemispherical end in an opposite direction relative to the other said hemispherical end when the toy is moving linearly.

* * * * *